US005190475A

United States Patent [19]

Dickens

[11] Patent Number: 5,190,475

[45] Date of Patent: Mar. 2, 1993

[54] ELECTRICALLY INSULATIVE CONNECTOR BOOTS

[75] Inventor: James A. Dickens, Mechanicsburg, Pa.

[73] Assignee: E. I. Du Pont de Nemours and Company, Wilmington, Del.

[21] Appl. No.: 831,723

[22] Filed: Feb. 5, 1992

[51] Int. Cl.[5] ..... H01R 13/40

[52] U.S. Cl. ..... 439/588; 174/138 F; 439/289; 439/366; 439/596; 439/892

[58] Field of Search ..... 174/138 F; 439/142, 439/281, 282, 287, 366, 367, 289, 290, 292, 587, 588, 596, 603, 607

[56] References Cited

U.S. PATENT DOCUMENTS

| | | | |
|---|---|---|---|
| 3,278,674 | 10/1966 | Matthysse | 174/138 |
| 3,484,541 | 12/1969 | Campbell | 174/138 |
| 3,701,079 | 10/1972 | Bowden et al. | 439/892 |
| 4,416,501 | 11/1983 | Fusselman et al. | 339/97 R |
| 4,514,029 | 4/1985 | Lax et al. | 439/588 |
| 4,539,748 | 9/1985 | Brown et al. | 29/874 |
| 4,707,043 | 11/1987 | Reed | 439/892 |
| 4,722,022 | 1/1988 | Myers et al. | 439/588 |
| 4,921,443 | 5/1990 | Sato | 439/521 |
| 4,990,100 | 2/1991 | Lukkes | 439/588 |
| 5,122,081 | 6/1992 | Bogiel et al. | 439/596 |
| 5,129,839 | 7/1992 | Van Skiver | 439/367 |

OTHER PUBLICATIONS

ANSI/IEEE Standard 488.1-1978, pp. 56-63.

*Primary Examiner*—Paula A. Bradley
*Attorney, Agent, or Firm*—John E. Griffiths

[57] ABSTRACT

Electrically insulative boots for substantially covering conductive connector housings and, in particular, conductive connector housings with a plug skirt and/or a receptacle skirt. The boots include a first electrically insulative shield connected to a second electrically insulative shield. The first shields include first and second plug flaps and/or first and second receptacle flaps. The flaps cover the plug skirt and/or a receptacle skirt when not connected to a mating connector assembly. The receptacle flaps are cammed away from the receptacle skirt by the plug flaps of a mating connector assembly allowing the plug skirt and receptacle skirt of mating connector assemblies to be adjacent to one another while the extractor of such mated connector assemblies remain electrically insulated.

10 Claims, 3 Drawing Sheets

ELECTRICALLY INSULATIVE CONNECTOR BOOTS

BACKGROUND OF THE INVENTION

1. Field of the Invention

This invention relates to electrically insulative boots for substantially covering conductive connector housings and, in particular, conductive connector housings with a plug skirt and/or a receptacle skirt.

2. Description of Related Art

Electrical connectors of the type having an exposed conductive metallic body are widely used, for instance, in the computer industry. In many applications, it is often desirable to generally enclose and electrically insulate such connectors to protect a user from shocks or worse without forming a waterproof or airtight seal around emerging terminal contacts. Many different insulating connector enclosures of this type have been commercially produced.

However, prior to this invention, electrically insulative boots have not been available for substantially covering conductive connector housings with mateable tubular conductive plug skirts and tubular conductive receptacle skirts. In particular, such a boot has not been available that (1) adequately electrically insulated the plug skirt and receptacle skirt of mateable connectors before they are connected together, (2) remained adequately electrically insulated after being mated together with the plug skirt and receptacle skirt of the mated connector assemblies immediately adjacent to one another, and (3) adequately electrically insulated the plug skirt and receptacle skirt after the mated connectors were disconnected from one another. Although such boots were not available, there was and is a need for such electrically insulative boots.

The invention satisfies this need which will be clear from the following description.

SUMMARY OF THE INVENTION

The present invention relates to an electrically insulative boot for covering a first conductive housing including a plug skirt and a receptacle skirt of a first stackable connector assembly, comprising:

a first electrically insulative shield for substantially covering a first half of the conductive housing, the first shield including:

a first plug flap for covering a first exterior side of the plug skirt, the first plug flap having at least one reinforcing rib with a first camming surface; and a first receptacle flap for covering a first exterior side of the receptacle skirt, an interior surface of the first receptacle flap adapted to ride along at least one of the first camming surfaces of one of the first plug flaps on a mating second stackable connector assembly thereby bending the first receptacle flap away from the receptacle skirt allowing the plug skirt of the mating second stackable connector assembly to be adjacent the receptacle skirt of the first stackable connector assembly when connected together; and a second electrically insulative shield connected to the first shield, the second shield for substantially covering a second half of the conductive housing, the second shield having a plug side and a receptacle side, the second shield including:

a second plug flap for covering a second exterior side of the plug skirt, the second plug flap having at least one reinforcing rib with a second camming surface; and a second receptacle flap for covering a second exterior side of the receptacle skirt, an interior surface of the second receptacle flap adapted to ride along at least one of the second camming surfaces of one of the second plug flaps on the mating second stackable connector assembly thereby bending the second receptacle flap away from the receptacle skirt allowing the plug skirt of the mating second stackable connector assembly to be adjacent the receptacle skirt of the first stackable connector assembly when connected together.

The present invention is further directed to an electrically insulative receptacle boot for covering a first conductive housing including a receptacle skirt of a first connector assembly, comprising:

a first electrically insulative shield for substantially covering a first half of the conductive housing, the first shield including a first receptacle flap for covering a first exterior side of the receptacle skirt, an interior surface of the first receptacle flap adapted to ride along at least one first camming surface of a first plug flap on a mating connector assembly thereby bending the first receptacle flap away from the receptacle skirt allowing a plug skirt of the mating connector assembly to be adjacent the receptacle skirt of the first connector assembly when connected together; and a second electrically insulative shield connected to the first shield, the second shield for substantially covering a second half of the conductive housing, the second shield including a second receptacle flap for covering a second exterior side of the receptacle skirt, an interior surface of the second receptacle flap adapted to ride along at least one second camming surface of a second plug flap on the mating connector assembly thereby bending the second receptacle flap away from the receptacle skirt allowing a plug skirt of the mating connector assembly to be adjacent the receptacle skirt of the first connector assembly when connected together.

The present invention is further directed to an electrically insulative plug boot for covering a first conductive housing including a plug skirt of a first connector assembly, comprising:

a first electrically insulative shield for substantially covering a first half of the conductive housing, the first shield including a first plug flap for covering a first exterior side of the plug skirt, the first plug flap having at least one reinforcing rib with a first camming surface for camming a first receptacle flap on a mating connector assembly thereby bending the first receptacle flap away from a receptacle skirt allowing the first plug skirt of the first connector assembly to be adjacent the receptacle skirt of the mating connector assembly when connected together; and a second electrically insulative shield connected to the first shield, the second shield for substantially covering a second half of the conductive housing, the second shield including a second plug flap for covering a second exterior side of the plug skirt, the second plug flap having at least one reinforcing rib with a second camming surface for camming a second receptacle flap on the mating connector assembly thereby bending the second receptacle flap away from the receptacle skirt allowing the second plug skirt of the first connector assembly to be adjacent the receptacle skirt of the mating connector assembly when connected together.

BRIEF DESCRIPTION OF THE DRAWINGS

The invention can be more fully understood from the following detailed description thereof in connection with accompanying drawings described as follows.

DESCRIPTION OF THE PREFERRED EMBODIMENT(S)

Figure 1:
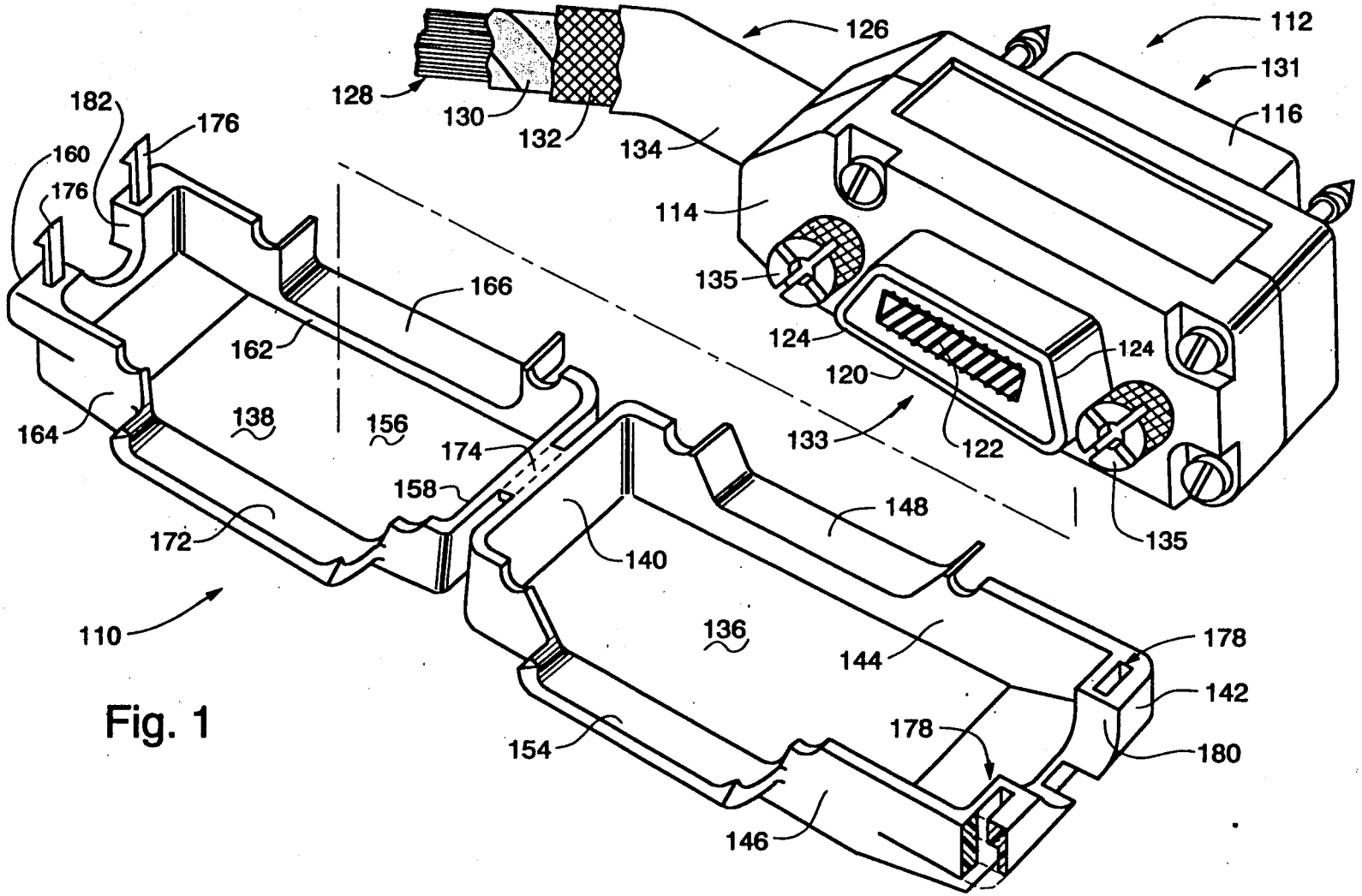
FIG. 1 is a perspective view of an electrically insulative boot for use on a cable assembly in accordance with the present invention, the boot being exploded from and in an open position for receiving a first connector assembly terminating the cable assembly.

Throughout the following detailed description, similar reference characters refer to similar elements in all figures of the drawings.

Figure 2:
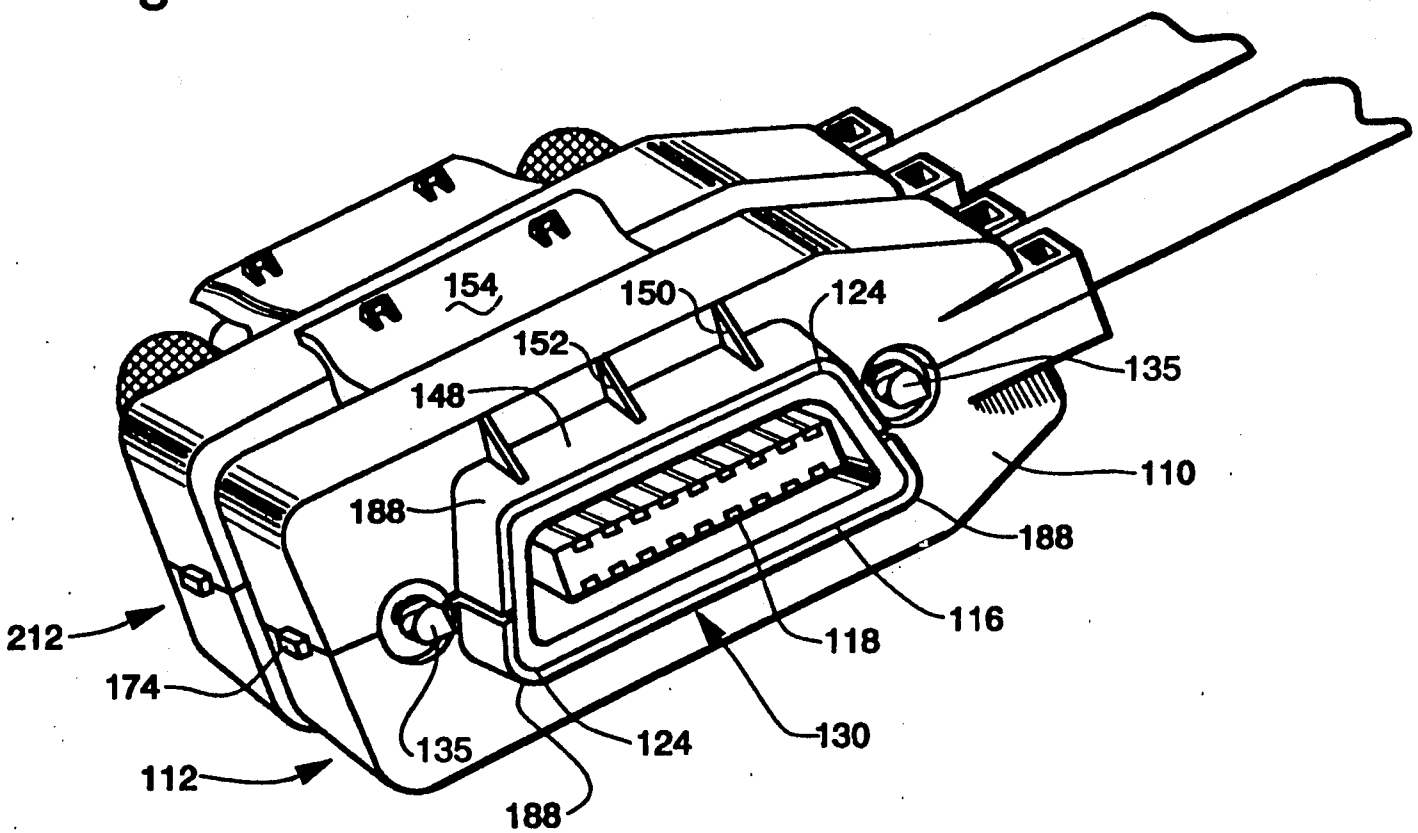
FIG. 2 is a perspective view of the first cable assembly connected to a second cable assembly.

Referring to FIGS. 1 and 2, there is illustrated an electrically insulative boot 110 in accordance with the present invention. The electrically insulative boot 110 of the present invention can be used to substantially cover any connector assembly 112 comprising a conductive housing 114 including (1) a conductive tubular plug skirt or shell 116 enclosing end portions 118 (i.e., contacts) of a first plurality of terminals and/or (2) a conductive tubular receptacle skirt or shell 120 enclosing end portions 122 (i.e., contacts) of a second plurality of terminals.

Figure 3:
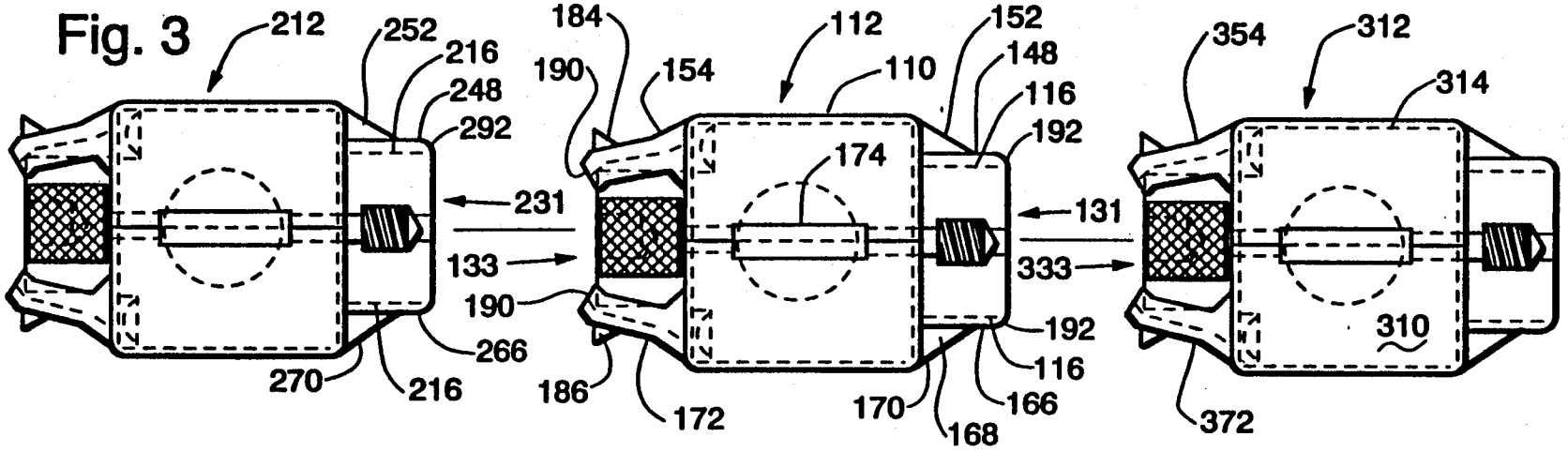
FIG. 3 is an end view of three of the cable assemblies of the present invention adjacent to one another before they are connected together.
Figure 4:
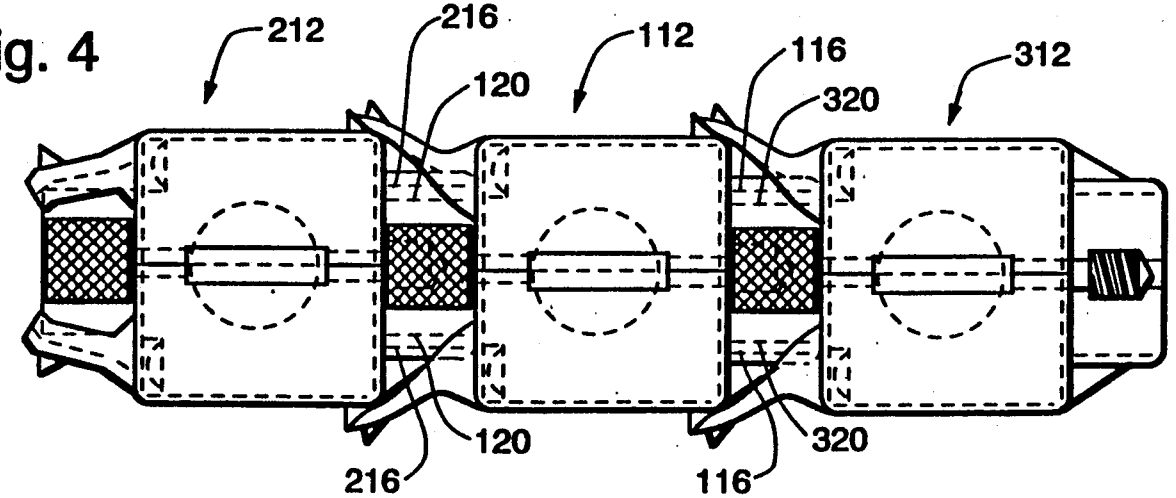
FIG. 4 is an end view of the three cable assemblies of FIG. 3 adjacent to one another after they are connected together in a stacked or piggy-back fashion.

Referring to FIGS. 3 and 4, the tubular plug skirt 116 is adapted to fit around the tubular receptacle skirt 120 such that both the plug skirt 116 of the connector assembly 112 and the receptacle skirt 320 of a mating connector assembly 312 enclose the end portions 118 of the first plurality of terminals of the first connector assembly 112 and the end portions (not depicted) of the second plurality of terminals of the mating connector assembly 312 when such end portions of the first and second plurality of terminals are in contact with each other.

Preferably, the plug skirt 116 and the receptacle skirt 120 have trapezoidal cross sections with curved corners 124. Also preferably, the connector assembly 112 substantially covered by the electrically insulative boot 110 is a stackable or piggy-back connector assembly 112 terminating a shielded cable 126 such as disclosed in U.S. Pat. No. 4,416,501, assigned to E. I. du Pont de Nemours and Company, which is hereby incorporated by reference. In this case, the combined assembly can be referred to as a cable assembly which includes the stackable or piggy-back connector assembly 112 terminating the shielded cable 126. Referring to FIG. 1, the shielded cable 126 may include a plurality of conductors 128 covered in turn by an aluminized Mylar ® layer 130, a flexible conductive shield 132 and an outer layer of insulation 134. The stackable or piggy-back connector assembly 112 terminates the conductors with the first plurality of terminals 118 in a plug, plug interface or plug connector 131 and with the second plurality of terminals 122 in a receptacle, receptacle interface or receptacle connector 133 in a manner that enables more than one connector assembly 112, 212, 312, etc., to be connected together as illustrated in FIGS. 2 and 4 in order to connect to a single port, such as, on a computer or a peripheral device.

Specifically, referring to FIGS. 3 and 4, the plug interface 131 of a first one 112 of the connector assemblies can be connected to the receptacle 333 of a mating connector assembly 312 or a receptacle port (not depicted), such as, on a computer or other peripheral device. Then the plug interface 231 of another one 212 of the connector assemblies can be connected to the receptacle interface 133 of the first connector assembly 112. Additional connector assemblies can be attached in a similar manner. All of the additional connector assemblies 212, 312, etc., can be, but need not be, identical to the first connector assembly 112. The numbers used herein to refer to parts of the additional connector assemblies 212, 312, etc., are the same numbers increased by multiples of 100 as the numbers used to refer to corresponding parts on the first connector assembly 112.

Referring to FIG. 1, the stackable or piggy-back connector assembly 112 may include a pair of captive locking screws 135 for securing mating connector assemblies 112 together. The stackable or piggy-back connector assembly 112 includes the conductive shroud or housing 114 electrically grounded to the flexible conductive shield 132 in the cable 126 for superior EMC performance and to minimize susceptibility to external noise. Such stackable connector assemblies 112 are commercially available from many sources, such as the connector assemblies designed to meet ANSI/IEEE Standard 488.1-1978.

The electrically insulative boot 110 comprises a first electrically insulative shield 136 and a second electrically insulative shield 138 connected to the first shield 136. The first electrically insulative shield 136 is for substantially covering a first or top half of the conductive housing 114. The second electrically insulative shield 138 is for substantially covering a second half or bottom of the conductive housing 114.

Referring to FIG. 1, the first shield 136 includes a hinge end 140 and a latch or slot end 142. The first shield 136 can further include either a plug side 144 or a receptacle side 146. Preferably, the first shield 136 includes both the plug side 144 and the receptacle side 146.

On its plug side 144, the first shield 136 includes a first plug flap or lip 148 for covering a first or top exterior side of the plug skirt 116. Referring to FIGS. 2 and 3, the first plug flap 148 has at least one reinforcing rib 150 with a first camming surface 152. Preferably, the first plug flap 148 has two or three reinforcing ribs 150, each rib 150 with one of the first camming surfaces 152. Referring to FIGS. 3 and 4, the first camming surfaces 152 are for camming a first receptacle flap 354 on a mating connector assembly 312 thereby camming or bending the first receptacle flap 354 away from a receptacle skirt 320 allowing the first plug skirt 116 of the first connector assembly 112 to be adjacent the receptacle skirt 320 of the mating connector assembly 312 when connected together.

On its receptacle side 146, the first shield 136 includes a first receptacle flap 154 for covering a first or bottom exterior side of the receptacle skirt 120. An interior surface of the first receptacle flap 154 is adapted to ride along at least one of the first camming surfaces 252 of a first plug flap 248 on a mating stackable connector assembly 212 thereby camming or bending the first receptacle flap 154 away from the receptacle skirt 120 allowing the plug skirt 216 of the mating stackable connector assembly 212 to be adjacent the receptacle skirt 120 of the first stackable connector assembly 112 when connected together.

Referring to FIG. 1, the second shield 156 includes a hinge end 158 and a latch or slot end 160. The second shield 156 further includes either a plug side 162 or a receptacle side 164, and preferably both the plug side 162 and the receptacle side 164. When the first shield 136 does not include a plug side 144 or a receptacle side 146, the second shield 156 does not include a plug side 162 or a receptacle side 164, respectively.

On its plug side 162, the second shield 156 includes a second plug flap or lip 166 for covering a second or bottom exterior side of the plug skirt 116. Referring to FIG. 3, the second plug flap 166 has at least one reinforcing rib 168 with a first camming surface 170. Preferably, the second plug flap 168 has two or three reinforcing ribs 168, each rib 168 with a second camming surface 170. The second camming surfaces 170 are for camming a second receptacle flap 372 on the mating connector assembly 312 thereby camming or bending the second receptacle flap 372 away from the receptacle skirt 320 allowing the second plug skirt 116 of the first connector assembly 112 to be adjacent the receptacle skirt 120 of the mating connector assembly 312 when connected together.

On its receptacle side 164, the second shield 156 includes a second receptacle flap 172 for covering a second exterior side of the receptacle skirt 120. An interior surface of the second receptacle flap 172 is adapted to ride along the second camming surfaces 270 of one of the second plug flaps 266 on the mating stackable connector assembly 212 thereby camming or bending the second receptacle flap 172 away from the receptacle skirt 120 allowing the plug skirt 216 of the mating stackable connector assembly 212 to be adjacent the receptacle skirt 120 of the first stackable connector assembly 112 when connected together.

When the first and second shields 136, 156 have plug sides 148, 166, but not receptacle sides 154, 172 as defined herein, they comprise an electrically insulative plug boot. When the first and second shields 136, 156 have receptacle sides 154, 172, but not plug sides 148, 166 as defined herein, they comprise an electrically insulative receptacle boot.

The electrically insulative boot 110 further includes a living hinge 174 connecting the hinge end 140 of the first shield 136 and the hinge end 158 of the second shield 156. The term "living hinge" means the first shield 136, the second shield 156 and the hinge 174 are made in one integral part from the same material, such as, in an injection molding process.

The electrically insulative boot 110 further includes a pair of latches 176 on the latch or slot end 142, 160 of a first one of the first shield 136 and the second shield 156. Further included are a pair of slots 178 on the latch or slot end 142, 160 of a second one of the first shield 136 and the second shield 156. The slots 178 are for receiving and holding the latches 176. If the connector assembly 112 is attached to a cable 126, a first recess 180 is present in the first shield 136 between the pair of latches 176 or slots 178 and a second recess 182 is in the second shield 156 between the pair of slots 178 or latches 176. The first and second recesses 180, 182 are for receiving the cable 126 connected to the first connector assembly 212.

Referring to FIG. 3, preferably, at least one first protrusion 184 is on an exterior side of the first receptacle flap 154 to prevent insertion of the first receptacle flap 154 between the first plug flap 248 on the mating connector assembly 212 and the plug skirt 216 of the mating connector assembly 212. Similarly, preferably, at least one second protrusion 186 is on an exterior side of the second receptacle flap 172 to prevent insertion of the second receptacle flap 172 between the second plug flap 266 on the mating connector assembly 212 and the plug skirt 216 of the mating connector assembly 212.

If the plug skirt 116 and the receptacle skirt 120 have trapezoidal cross sections with curved corners 124, the first plug flap 148, the second plug flap 166, the first receptacle flap 154 and the second receptacle flap 172 preferably have curved end portions 188 to cover the curved corners. See FIG. 2.

Referring to FIG. 3, preferably, the first and second receptacle flaps 154, 172 have inclined insertion end surfaces 190 for riding on curved insertion ends 292 of the first and second plug flaps 248, 266 on the mating connector assembly 212. Similarly, preferably, the first and second plug flaps 148, 166 have curved insertion ends 192.

The present invention is further directed to combinations of the above described boots, connector assemblies and/or cable assemblies. For instance, one such electrically insulated connector assembly in accordance with the present invention comprises the first connector assembly 112 and the mating connector assembly 312. Referring to FIGS. 3 and 4, the first connector assembly 112 includes the first conductive housing 114 including the plug skirt 116 and the first electrically insulative boot 110 for substantially covering the first conductive housing 114. The first boot comprises the first plug flap 148 and the second plug flap 166. The second connector assembly 312 includes the second conductive housing 314 including the receptacle skirt 320 mateable with the plug skirt 116 and the second electrically insulative boot 310 for substantially covering the second conductive housing 314. The second boot 310 comprises the first receptacle flap 354 and the second receptacle flap 372. Thus, when the plug skirt 116 and the receptacle skirt 320 are pushed together to mate, the first and second camming surfaces 152, 170 bend or cam the first and second receptacle flaps 354, 372 away from the receptacle skirt 320 allowing the plug shirt 116 to be adjacent the receptacle skirt 320.

As is readily apparent from the above description and the Figures, the electrically insulative boot 110 adequately electrically insulates the plug skirt 116 and receptacle skirt 320 of mateable connectors 112, 312 before they are connected together. The plug skirt 116 and receptacle skirt 320 of mateable connectors 112, 312 remain adequately electrically insulated after being mated together with the plug skirt 116 and receptacle skirt 320 of the mated connector assemblies 112, 312 immediately adjacent to one another. Further, the plug skirt 116 and receptacle skirt 320 remain adequately electrically insulated after the mated connectors 112, 312 are disconnected from one another.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An electrically insulative boot for covering a first conductive housing including a plug skirt and a receptacle skirt of a first stackable connector assembly, comprising:

a first electrically insulative shield for substantially covering a first half of the conductive housing, the first shield including:

a first plug flap for covering a first exterior side of the plug skirt, the first plug flap having at least one reinforcing rib with a first camming surface; and a first receptacle flap for covering a first exterior side of the receptacle skirt, an interior surface of the first receptacle flap adapted to ride along at least one of the first camming surfaces of one of the first plug flaps on a mating second stackable connector assembly thereby bending the first receptacle flap away from the receptacle skirt allowing the plug skirt of the mating second stackable connector assembly to be adjacent the receptacle skirt of the first stackable connector assembly when connected together; and a second electrically insulative shield connected to the first shield, the second shield for substantially covering a second half of the conductive housing, the second shield having a plug side and a receptacle side, the second shield including:

a second plug flap for covering a second exterior side of the plug skirt, the second plug flap having at least one reinforcing rib with a second camming surface; and a second receptacle flap for covering a second exterior side of the receptacle skirt, an interior surface of the second receptacle flap adapted to ride along at least one of the second camming surfaces of one of the second plug flaps on the mating second stackable connector assembly thereby bending the second receptacle flap away from the receptacle skirt allowing the plug skirt of the mating second stackable connector assembly to be adjacent the receptacle skirt of the first stackable connector assembly when connected together.

2. The electrically insulative boot of claim 1, wherein the plug skirt and the receptacle skirt have trapezoidal cross sections with curved corners; and further comprising:

the first plug flap, the second plug flap, the first receptacle flap and the second receptacle flap having curved end portions to cover the curved corners.

3. An electrically insulative plug boot for covering a first conductive housing including a plug skirt of a first connection assembly, comprising:

a first electrically insulative shield for substantially covering a first half of the conductive housing, the first shield including a first plug flap for covering a first exterior side of the plug skirt, the first plug flap having at least one reinforcing rib with a first camming surface for camming a first receptacle flap on a mating connector assembly thereby bending the first receptacle flap away from a receptacle skirt allowing the first plug skirt of the first connector assembly to be adjacent the receptacle skirt of the mating connector assembly when connected together; and a second electrically insulative shield connected to the first shield, the second shield for substantially covering a second half of the conductive housing, the second shield including a second plug flap for covering a second exterior side of the plug skirt, the second plug flap having at least one reinforcing rib with a second camming surface for camming a second receptacle flap on the mating connector assembly thereby bending the second receptacle flap away from the receptacle skirt allowing the second plug skirt of the first connector assembly to be adjacent the receptacle skirt of the mating connector assembly when connected together.

4. The electrically insulative boot of claim 1 or 3, wherein:

the first receptacle flap having an inclined insertion end surface for riding on a curved insertion end of one of the first plug flaps on a mating connector assembly; and the second receptacle flap having an inclined insertion end surface for riding on a curved insertion end of one of the second plug flaps on the mating connector assembly.

5. An electrically insulative receptacle boot for covering a first conductive housing including a receptacle skirt of a first connector assembly, comprising:

a first electrically insulative shield for substantially covering a first half of the conductive housing, the first shield including a first receptacle flap for covering a first exterior side of the receptacle skirt, an interior surface of the first receptacle flap adapted to ride along at least one first camming surface of a first plug flap on a mating connector assembly thereby bending the first receptacle flap away from the receptacle skirt allowing a plug skirt of the mating connector assembly to be adjacent the receptacle skirt of the first connector assembly when connected together; and a second electrically insulative shield connected to the first shield, the second shield for substantially covering a second half of the conductive housing, the second shield including a second receptacle flap for covering a second exterior side of the receptacle skirt, an interior surface of the second receptacle flap adapted to ride along at least one second camming surface of a second plug flap on the mating connector assembly thereby bending the second receptacle flap away from the receptacle skirt allowing a plug skirt of the mating connector assembly to be adjacent the receptacle skirt of the first connector assembly when connected together.

6. The electrically insulative boot of claim 3 or 5, further comprising:

a living hinge connecting a hinge end of the first shield and a hinge end of the second shield.

7. The electrically insulative boot of claim 3 or 5, further comprising:

at least one first protrusion on an exterior side of the first receptacle flap to prevent insertion of the first receptacle flap between one of the first plug flaps on a mating connector assembly and the plug skirt of the mating connector assembly; and at least one second protrusion on an exterior side of the second receptacle flap to prevent insertion of the second receptacle flap between one of the second plug flaps on the mating connector assembly and the plug skirt of the mating connector assembly.

8. The electrically insulative boot of claim 1, 3 or 5, further comprising:

a pair of latches on a latch end of a first one of the first shield and the second shield; and a pair of slots on a latch end of a second one of the first shield and the second shield, the slots for receiving and holding the latches.

9. The electrically insulative boot of claim 8, further comprising:

a first recess in the first shield between the pair of latches or slots; and a second recess in the second shield between the pair of slots or latches, the first and second recesses for receiving a cable connected to the first connector assembly.

10. An electrically connector assembly, comprising:

a first connector assembly having a first conductive housing including a plug skirt and a first electrically insulative boot for substantially covering a first conductive housing, the first boot comprising:

a first plug flap for covering a first exterior side of the plug skirt, the first plug flap having at least one reinforcing rib with a first camming surface;

a second plug flap for covering a second exterior side of the plug skirt, the second plug flap having at least one reinforcing rib with a second camming surface;

a second connector assembly having a second conductive housing including a receptacle skirt mateable with the plug skirt and a second electrically insulative boot for substantially covering the second conductive housing, the second boot comprising:

a first receptacle flap for covering a first exterior side of the receptacle skirt, an interior surface of the first receptacle flap adapted to ride along the first camming surface of the first plug flap on the first connector assembly; and a second receptacle flap for covering a second exterior side of the receptacle skirt, an interior surface of the second receptacle flap adapted to ride along the second camming surface of the second plug flap on the first connector assembly, whereby when the plug skirt and the receptacle skirt are pushed together to mate, the reinforcing ribs bend the first and second receptacle flaps away from the receptacle skirt allowing the plug shirt to be adjacent the receptacle skirt.

* * * * *